US008054229B2

(12) United States Patent
Kaneoya

(10) Patent No.: US 8,054,229 B2
(45) Date of Patent: Nov. 8, 2011

(54) ANTENNA AND PORTABLE WIRELESS DEVICE

(75) Inventor: Masanori Kaneoya, Musashimurayama (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 826 days.

(21) Appl. No.: 11/820,130

(22) Filed: Jun. 18, 2007

(65) Prior Publication Data

US 2008/0001833 A1 Jan. 3, 2008

(30) Foreign Application Priority Data

Jun. 28, 2006 (JP) ..... 2006-178830

(51) Int. Cl.
*H01Q 1/24* (2006.01)

(52) U.S. Cl. ..... 343/702

(58) Field of Classification Search ..... 343/702, 343/895, 700 MS; 455/90, 575.5
See application file for complete search history.

(56) References Cited

U.S. PATENT DOCUMENTS

| | | | | |
|---|---|---|---|---|
| 6,456,242 | B1 * | 9/2002 | Crawford | 343/700 MS |
| 6,456,245 | B1 * | 9/2002 | Crawford | 343/702 |
| 6,850,197 | B2 * | 2/2005 | Paun | 343/702 |
| 6,876,332 | B1 * | 4/2005 | Chung et al. | 343/702 |
| 6,879,849 | B2 * | 4/2005 | Begic | 455/575.7 |
| 6,992,631 | B2 * | 1/2006 | Lu | 343/700 MS |
| 7,397,431 | B2 * | 7/2008 | Baliarda et al. | 343/702 |
| 7,405,703 | B2 * | 7/2008 | Qi et al. | 343/702 |
| 2005/0099335 | A1 | 5/2005 | Chung et al. | |
| 2005/0212704 | A1 | 9/2005 | Hofmann | |

FOREIGN PATENT DOCUMENTS

| | | |
|---|---|---|
| EP | 0 526 643 | 2/1993 |
| EP | 1 263 083 | 12/2002 |
| EP | 1 575 125 | 9/2005 |
| EP | 1 608 035 | 12/2005 |
| EP | 1 638 165 | 3/2006 |
| JP | 3033537 | 6/1996 |
| JP | 3033537 U | 11/1996 |
| JP | 09-260922 | 10/1997 |
| JP | 11-284427 | 10/1999 |
| JP | 2001-168620 | 6/2001 |

(Continued)

OTHER PUBLICATIONS

Office Action dated Apr. 8, 2008 (with English translation) issued for the Japanese Patent Application No. 2006-178830.

*Primary Examiner* — Huedung Mancuso
(74) *Attorney, Agent, or Firm* — Cozen O'Connor

(57) ABSTRACT

A dual-band antenna with little limitation on the mounting space, which allows two antenna elements coping with different frequency bands to be laid out at a narrow space, and a portable wireless device having the same are provided. A band-like first antenna element, a sheet-like dielectric element, and a band-like second antenna element are fitted in a groove of a support member. The end portion of the second antenna element overlaps with the end portion of the first antenna element, and the dielectric element is sandwiched therebetween. The sandwiched dielectric element constitutes a capacitor, and first antenna element, the capacitor and the second antenna element are connected in series. The other end portion of the second antenna element is connected to a circuit in a bottom casing, and power is supplied through the other end portion thereof.

17 Claims, 11 Drawing Sheets

FOREIGN PATENT DOCUMENTS

| | | |
|---|---|---|
| JP | 2002-064329 | 2/2002 |
| JP | 2002-504768 | 2/2002 |
| JP | 2004-253927 | 9/2004 |
| JP | 2004-266811 | 9/2004 |
| JP | 2005-020228 | 1/2005 |
| JP | 2005-217917 | 8/2005 |
| JP | 2005-269301 | 9/2005 |
| WO | WO 2004/006385 | 1/2004 |

* cited by examiner

——— : DIRECTIVITY ACCORDING TO EMBODIMENT

..... : DIRECTIVITY ACCORDING TO COMPARATIVE EXAMPLE

——— : DIRECTIVITY ACCORDING TO EMBODIMENT

..... : DIRECTIVITY ACCORDING TO COMPARATIVE EXAMPLE

ANTENNA AND PORTABLE WIRELESS DEVICE

BACKGROUND OF THE INVENTION

1. Field of the Invention

The present invention relates to an antenna which can cope with different frequency bands, and a portable wireless device having the same.

2. Description of the Related Art

It is necessary for recent portable wireless devices, in particular, cellular phones to cope with radio waves of different frequency bands because of diversified and multifunctional communication. For example, in Japan, the band of 800 MHz and the band of 2 GHz are allocated as communication frequency bands for cellular phones, and when a communication carrier which provides a cellular phone communication service uses both the frequency bands for communications, a cellular phone must have antennas coping with the respective frequency bands. Meanwhile, there are cellular phones which have a function of receiving a radio wave used for a PHS (Personal Handy-phone System), a radio wave used for the Bluetooth (registered trademark) or the like, and have a function of transmitting/receiving a radio wave of a TV signal, a radio wave of a radio signal, a radio wave of a GPS (Global Positioning System) signal or the like, and such cellular phones must have antennas corresponding to the respective added functions.

It is desirable that a portable wireless device which transmits and receives radio waves of different frequency bands should have antenna elements of the respective frequency bands connected to a circuit board through a common terminal from the standpoint of the limitation of the wiring patterning of the circuit board, i.e., it is desirable that the portable wireless device should have a dual-band antenna or the like. Unexamined Japanese Patent Application KOKAI Publication No. 2002-64329 discloses plural types of antennas formed of a conductive pattern, as dual-band antennas.

One of the antennas is a meander line antenna (8) which has two meander line sections (8A, 8B), which have different meander intervals, formed in series on the internal surface of a flipper attached free to open or close to the body of a cellular phone, with the end portion of a first meander line section (8A) whose meander interval is broader connected to a circuit board. This meander line antenna (8) has electrical lengths and meander patterns set for the first meander line section (8A) and for the second meander line section (8B) respectively, such that the first meander line section (8A) and the second meander line section (8B) function as antenna in the band of 800 MHz, and such that only the first meander line section (8A) functions as antenna in the band of 1.9 GHz.

The other one of the antennas is an antenna (21) which has a ¼-wavelength antenna element (21A) coping with the 800 MHz band and a ¼-wavelength antenna element (21B) coping with the 1.9 GHz band formed in parallel on the internal surface of the flipper, with the end portion of the antenna element (21A) and the end portion of the antenna element (21B) connected to a circuit board to be simultaneously supplied with power.

Unexamined Japanese Patent Application KOKAI Publication No. 2005-269301 discloses an antenna formed of a metallic plate, as a dual-band antenna. This antenna has two antenna elements (a ¼-wavelength antenna element 1 coping with the 900 MHz band, and a ¼-wavelength antenna element 2 coping with the 1.8 GHz or 1.9 GHz band), each of which is formed by bending a metallic plate into a reversed-L shape such that each has a horizontal portion (1*a*, 2*a*) and a vertical portion (1*b*, 2*b*), and the two antenna elements are arranged such that the horizontal portions face each other with a predetermined gap therebetween, and such that the end portions of the vertical portions are connected in common to be simultaneously supplied with power.

SUMMARY OF THE INVENTION

The antenna disclosed in Unexamined Japanese Patent Application KOKAI Publication No. 2002-64329 has the antenna elements formed as conductive patterns on the surface of a case member. Therefore, the space where the antenna can be formed is limited and the manufacture of the antenna is complicated. Not only the antenna with two antenna elements arranged in parallel, but also the meander line antenna require a two-dimensionally wide space, as a space where the antenna elements are to be disposed.

The antenna disclosed in Unexamined Japanese Patent Application KOKAI Publication No. 2002-64329 has the two reversed-L-shaped antennal elements arranged to have their horizontal portions face each other with a predetermined gap therebetween.

Therefore, the antenna is difficult to form into a thin body, and space where the antenna can be provided is limited.

Therefore, it is an object of the invention to provide a dual-band antenna which has little limitation on the mounting space, and a portable wireless device having the same. To achieve the object, an antenna of the invention comprises: a first antenna element formed in a band-like shape and coping with a first frequency band; a second antenna element formed in a band-like shape, coping with a second frequency band, and having one end portion partially overlapped with one end portion of the first antenna element; and a dielectric element sandwiched between the first antenna element and the second antenna element at that portion where the first antenna element and the second antenna element overlap with each other, wherein the other end of the second antenna element serves as a power feeding end.

In the antenna according to the invention, the first antenna element may have an electrical length which is a half wavelength of a center frequency of the first frequency band, and the second antenna element may have an electrical length which is a quarter wavelength of a center frequency of the second frequency band.

In the antenna according to the invention, a frequency in the first frequency band may be higher than a frequency in the second frequency band.

In the antenna according to the invention, the first antenna element may be formed in a letter U shape.

In the antenna according to the invention, the first antenna element and the second antenna element may be made of a metal which is anticorrosive.

In the antenna according to the invention, the first antenna element, and dielectric element, and the second antenna element may be wrapped by a rubber-based resin.

The first antenna element, the dielectric element, and the second antenna element are laid out on a surface of a support member, and wrapped together with the support member by the rubber-based resin.

The support member includes a band-like groove on its surface, and the first antenna element, the dielectric element, and the second antenna element are retained and arranged in the band-like groove.

On the other hand, to achieve the object, a portable wireless device according to the invention has the antenna described above, or an antenna according to each mode of the antenna.

According to the invention, the second antenna element partially overlaps a portion of the first antenna element, the dielectric element is sandwiched between the first antenna element and the second antenna element at that portion where the first antenna element and the second antenna element overlap with each other, so that a capacitor is constituted between the first antenna element and the second antenna element. That is, the first antenna element, the capacitor, and the second antenna element are so structured as to be connected in series. Accordingly, when the other end of the second antenna element is connected to a circuit, the first antenna element can receive a radio wave in the first frequency band, while the second antenna element can receive a radio wave in the second frequency band. On the other hand, when power of the first frequency band is supplied from the circuit, the first antenna element can transmit a radio wave in the first frequency band, and when power of the second frequency band is supplied, the second antenna element can transmit a radio wave in the second frequency band. Resonance with different frequency bands can be realized with such a simple structure.

Because the first antenna element and the second antenna element are both formed in a band-like shape, and these two antenna elements are connected in series via the dielectric element, a space two dimensionally wide to dispose those elements is not necessary. Because the first antenna element and second antenna element are formed in a band-like shape, it is possible to set the planar shape of the first antenna element and the second antenna element relatively freely, by providing a curved portion and a bent portion to the first antenna element and the second antenna element. Therefore, there is little limitation regarding a place or a space for disposing the first antenna element and second antenna element.

DETAILED DESCRIPTION OF THE PREFERRED EMBODIMENT

An explanation will be given of a preferred embodiment for carrying out the invention with reference to the accompanying drawings. Note that there are various limitations which are technically preferable to carry out the invention in the following embodiment, but it should be understood that the scope of the invention is not limited to the following embodiment and illustrated examples.

Figure 1:
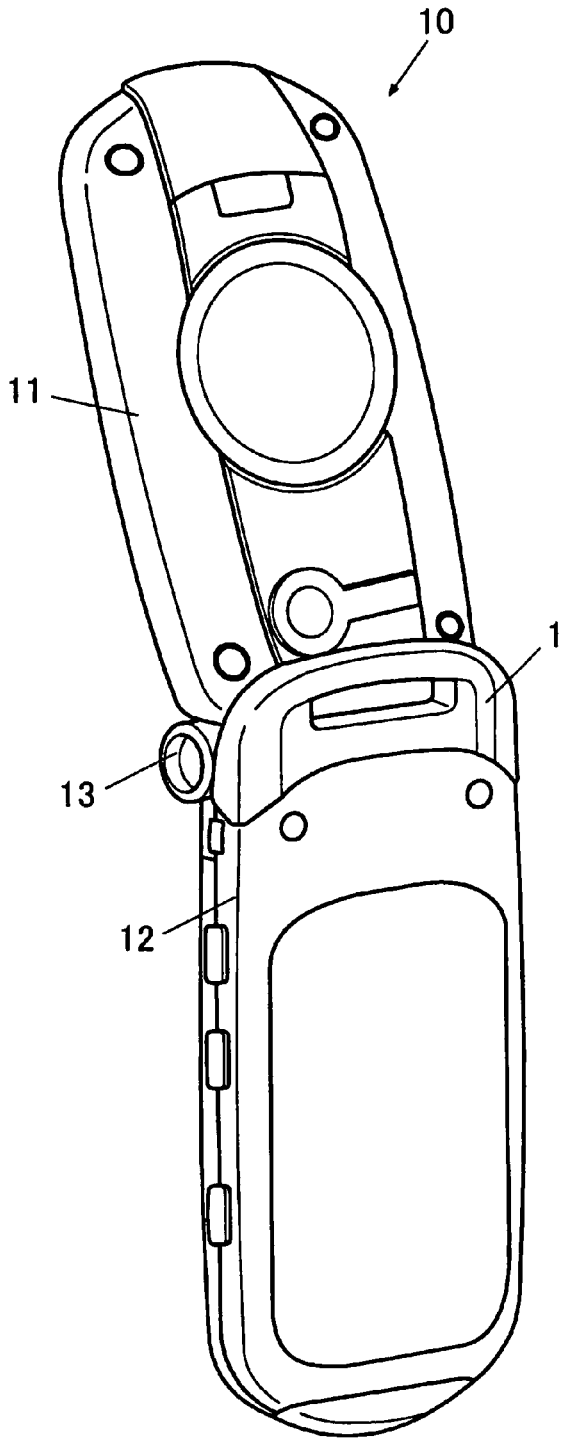
FIG. 1 is a perspective view showing a cellular phone.

FIG. 1 is a perspective view showing the back of a cellular phone 10.

According to the cellular phone 10, an upper casing 11 is linked with a bottom casing 12 by a hinge portion 13, and is rotatable with respect to the bottom casing 12 around the hinge axis of the hinge portion 13. With the upper casing 11 being closed with respect to the bottom casing 12, the front face of the upper casing 11 faces the front face of the bottom casing 12, and with the upper casing 11 being opened with respect to the bottom casing 12, both front face of the upper casing 11 and front face of the bottom casing 12 face the front.

Figure 2:
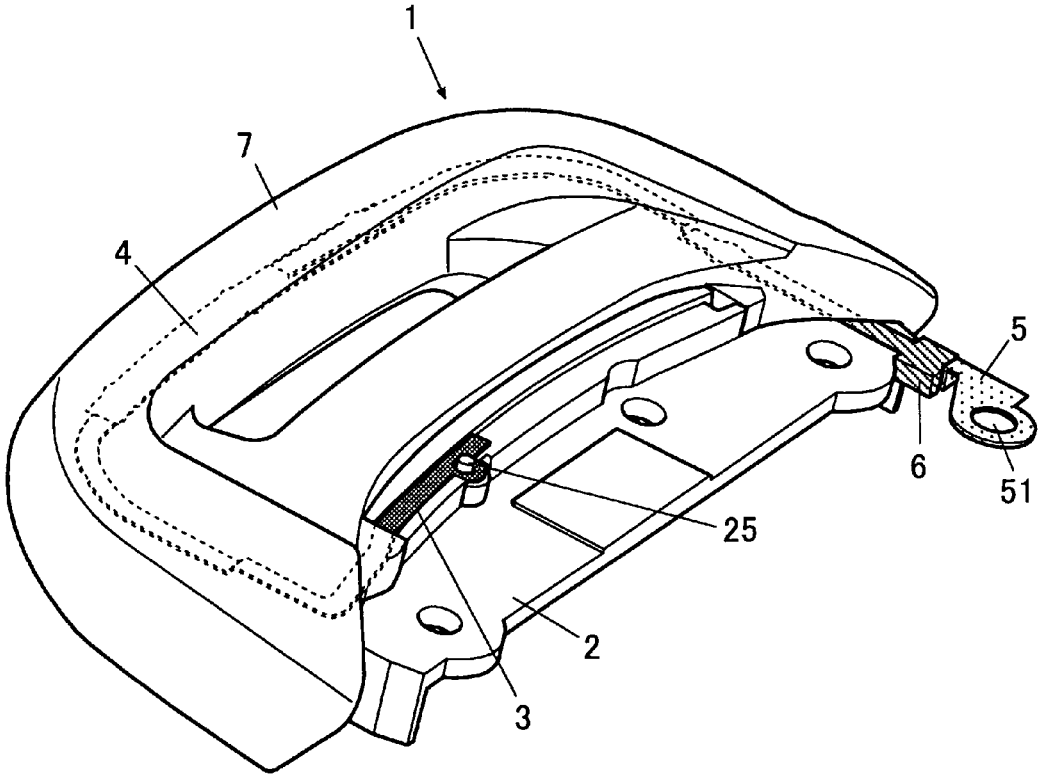
FIG. 2 is a perspective view showing an antenna.

An antenna 1 is attached to the end portion of the bottom casing 12 at the hinge portion 13 side, and is disposed behind the hinge portion 13. FIG. 2 is a perspective view showing the antenna 1 detached from the bottom casing 12, and FIG. 3 is a perspective view showing the antenna 1 disassembled part by part.

Figure 3:
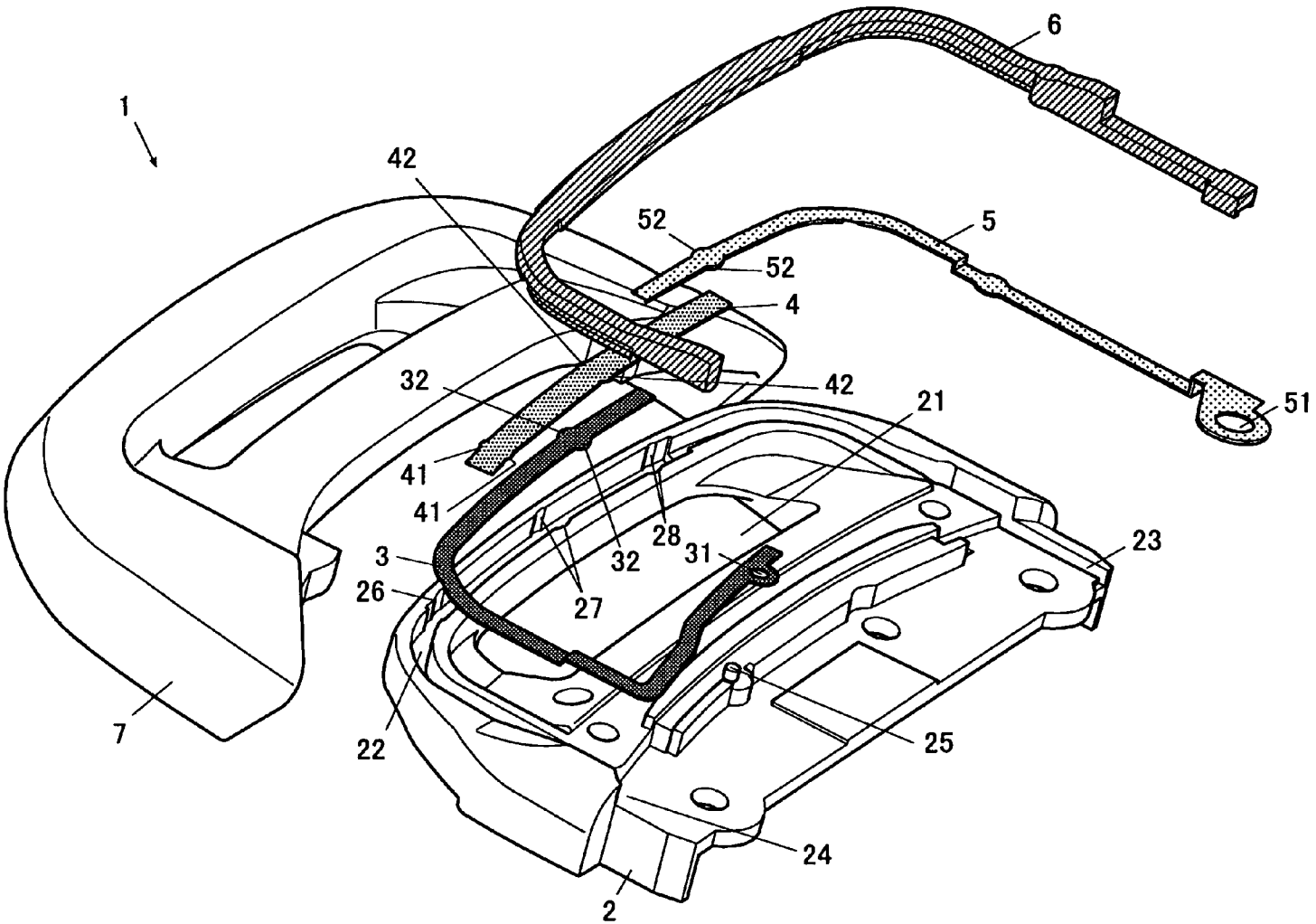
FIG. 3 is an exploded perspective view showing the antenna disassembled.

As shown in FIGS. 2 and 3, the antenna 1 has a support member 2, a band-like first antenna element 3 laid out on the surface of the support member 2, a band-like and sheet-like dielectric element 4 stacked on the end portion of the first antenna element 3, and a band-like second antenna element 5 laid out on the support member 2 in such a manner as to partially overlap the dielectric element 4.

In addition, the antenna 1 has a holder 6 which holds the second antenna element 5, the dielectric element 4, and the first antenna element 3 against the support member 2 from above the second antenna element 5, the dielectric element 4, and the first antenna element 3 laid out on the support member 2. In addition, the antenna 1 has an exterior resin 7 which wraps the holder 6, the second antenna element 5, the dielectric element 4, the first antenna element 4, and the support member 2.

Note that the support member 2, the holder 6, and the exterior resin 7 are members that are required in a case where the antenna is formed as a type which is outwardly attached to the casing, and are not therefore the essential members of the antenna.

The support member 2 is made of an insulation material like a resin. The support member 2 has a horizontally long opening 21 formed in such a manner as to pass through the front face to the rear face. This opening 21 can be used as an opening to pass a strap through. The face of the support member 2 has a groove 22 formed along the rim of the support member 2 in such a manner as to surround the opening 21.

One end 23 of the groove 22 runs to the bottom rim of the support member 2 in FIG. 3, and an other end 24 of the groove 22 runs to a portion slightly over the bottom rim of the exterior resin 7 which encompasses the support member 2 in FIG. 3.

A protrusion 25 for positioning the first antenna element 3 is formed at a portion along the bottom rim of the exterior resin 7 near the center from the other end 24 of the groove 22. Recesses 26, 27, and 28 for positioning the antenna elements 3, 5, and the dielectric element 4 are formed at the side walls of the central part of the groove 22. The groove 22 becomes wide at the recesses 26, 27, and 28.

Figure 4A:
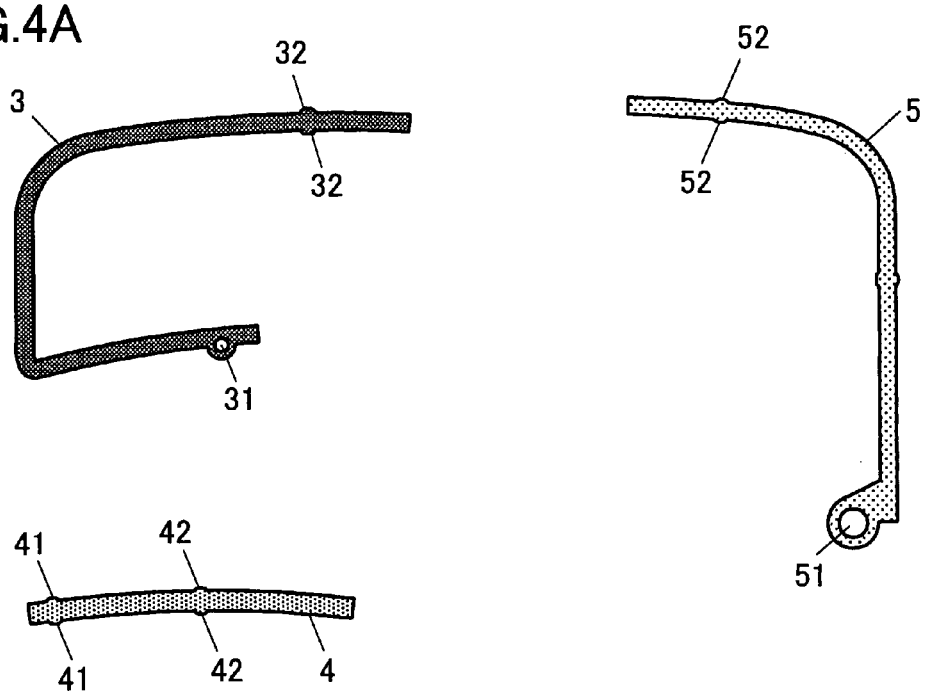
FIG. 4A is a top plan view of each of a first antenna element, a dielectric element and a second antenna element.
Figure 4B:
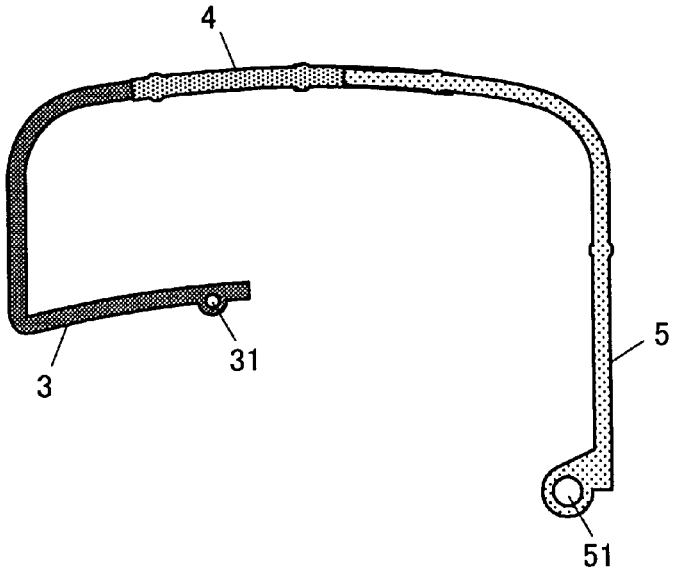
FIG. 4B is a top plan view showing the first antenna element, the dielectric element and the second antenna element stacked together.
Figure 5:
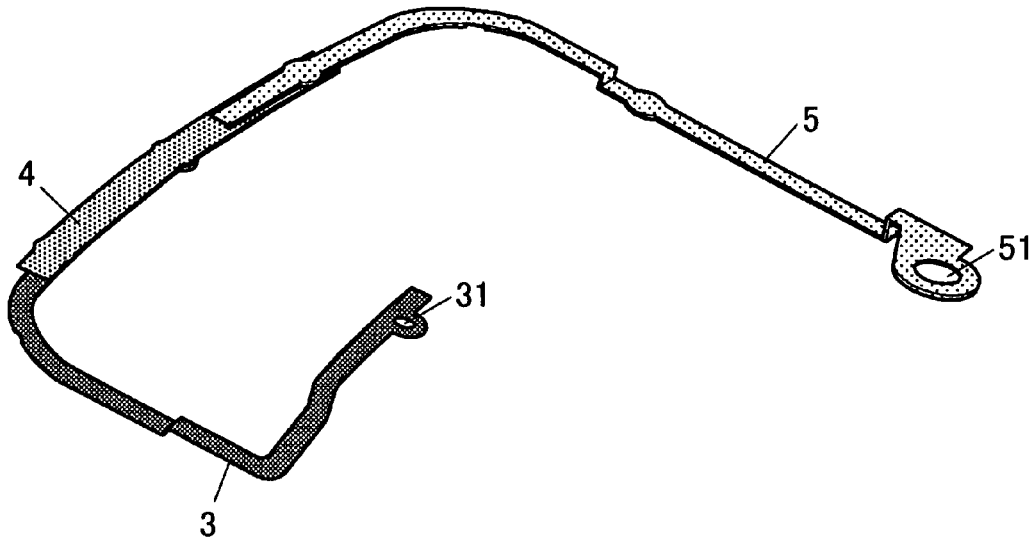
FIG. 5 is a perspective view showing the first antenna element, the dielectric element and the second antenna element stacked together.

FIG. 4A is a top plan view showing the first antenna element 3, the dielectric element 4 and the second antenna element 5, FIG. 4B is a top plan view showing the first antenna element 3, the dielectric element 4 and the second antenna element 5 stacked together, and FIG. 5 is a perspective view showing the first antenna element 3, the dielectric element 4 and the second antenna element 5 stacked together.

The first antenna element 3 is made of a metallic material (preferably, a metallic material which is anticorrosive, such a stainless steel, etc.), and is formed in a planar shape like a letter U. The first antenna element 3 is fitted in the groove 22 in such a manner as to surround the left portion of the opening 21 in FIG. 3. In the groove 22, the first antenna element 3 is laid out on the bottom of the groove 22. The first antenna element 3 has a through hole 31 formed at one end thereof, and the protrusion 25 is fitted in the through hole 31 (see, FIG. 2). Semicircular protrusions 32 is formed at both edges of the first antenna element 3 corresponding to the recesses 27 of the groove 22, and the protrusions 32 are fitted in the respective recesses 27.

The dielectric element 4 comprises a dielectric sheet like a resin sheet, etc, and is formed in a planar shape like a letter I. The dielectric element 4 is fitted in the middle portion of the groove 22, and overlaps the end portion of the first antenna element 3 (end portion opposite to the end portion where the through hole 31 is formed). Semicircular protrusions 41 are formed at both edges of the dielectric element 4 corresponding to the recesses 26 of the groove 22, and semicircular protrusions 42 are formed at both edges of the dielectric element 4 corresponding to the recesses 27. The protrusions 41 are fitted into the respective recesses 26, and the protrusions 42 are fitted into the respective recesses 27.

The second antenna element 5 is made of a metallic material (preferably, a metallic material which is anticorrosive, such a stainless steel, etc.), and is formed in a planar shape like a letter L. The second antenna element 5 is fitted in the groove 22 in such a manner as to run along the rim of the support member 2 from the end portion 23 of the groove 22 to the middle portion thereof. One end portion of the second antenna element 5 protrudes outward the end of the support member 2 through the end portion 23 of the groove 22, and has a through hole 51. The other end portion of the second antenna element 5 overlaps the dielectric element 4. Semicircular protrusions 52 are formed at both edges of the second antenna element 5 corresponding to the recesses 28 of the groove 22, and are fitted into the respective recesses 28.

As described above, as the dielectric element 4 is sandwiched between the end portion of the first antenna element 3 (end portion opposite to the end portion where the through hole 31 is formed) and the end portion of the second antenna element 5 (end portion opposite to the end portion where the through hole 51 is formed), a capacitor is constituted. The first antenna element 3, the capacitor, and the second antenna element 5 are connected in series from the end portion of the first antenna element 3 where the through hole 31 is formed to the end portion of the second antenna element 5 where the through hole 51 is formed. Because the first antenna element 3 is not connected to other conductive materials, electrical elements, and the like, the first antenna element 3 is merely coupled to the second antenna element 5 through the capacitor high-frequency-wise. With the antenna 1 being attached to the bottom casing 12, the end portion of the second antenna element 5 (end portion where the through hole 51 is formed) is connected to a circuit (to be more specific, a wireless circuit portion) in the bottom casing 12. That is, the end portion of the second antenna element 5 where the through hole 51 is formed serves as a power feeding end.

The electrical length of the first antenna element 3 is different from that of the second antenna element 5, and the first antenna element 3 and the second antenna element 5 have different frequency bands of radio waves strongly transmitted/received. For example, the electrical length of the first antenna element 3 is set to an electrical length that a radio wave of 2 GHz band can be strongly transmitted/received, and the electrical length of the second antenna element 5 is set to an electrical length that a radio wave of 800 MHz band can be strongly transmitted/received. Specifically, the electrical length of the first antenna element 3 is an electrical length corresponding to a half wavelength (or integral multiple of the half wavelength) of a radio wave having the center frequency of the 2 GHz band, and the electrical length of the second antenna element 5 is an electrical length corresponding to a quarter wavelength (or integral multiple of the quarter wavelength) of a radio wave having the center frequency of the 800 MHz band.

Accordingly, a radio wave in the 2 GHz band is received by the first antenna element 3 and sent through the capacitor and the second antenna element 5 to the circuit in the bottom casing 12 from the power feeding end of the second antenna element 5, and a radio wave in the 800 MHz band is received by the second antenna element 5 and sent to the circuit in the bottom casing 12 from the power feeding end of the second antenna element 5.

When power in the 2 GHz band is supplied to the power feeding end of the second antenna element 5 from the circuit in the bottom casing 12, a radio wave in the 2 GHz band is transmitted from the first antenna element 3. When power in the 800 MHz band is supplied to the power feeding end of the second antenna element 5 from the circuit in the bottom casing 12, a radio wave in the 800 MHz band is transmitted from the second antenna element 5.

As shown in FIGS. 2 and 3, the holder 6 is fitted into the groove 22 over the first antenna element 3, the dielectric element 4, and the second antenna element 5, and presses the first antenna element 3, the dielectric element 4, and the second antenna element 5 against the bottom of the groove 22. It is preferable that the width of the holder 6 should be the same or slightly larger than the width of the groove 22 in the state of that the holder 6 is not put into the groove 22, so that the holder 6 is not easily detached from the groove 22.

The exterior resin 7 is made of a rubber-based resin. The exterior resin 7 is formed on the support member 2 in such a manner as to wrap the holder 6, the second antenna element 5, the dielectric element 4, the first antenna element 3, and the support member 2. The first antenna element 3, the second antenna element 5, and the support member 2 are not completely inserted in the exterior resin 7, but the end portion of the first antenna element 3 where the through hole 31 is formed, the end portion of the second antenna element 5 where the through hole 51 is formed, and the lower end portion of the support member 2 are exposed.

Figure 6:
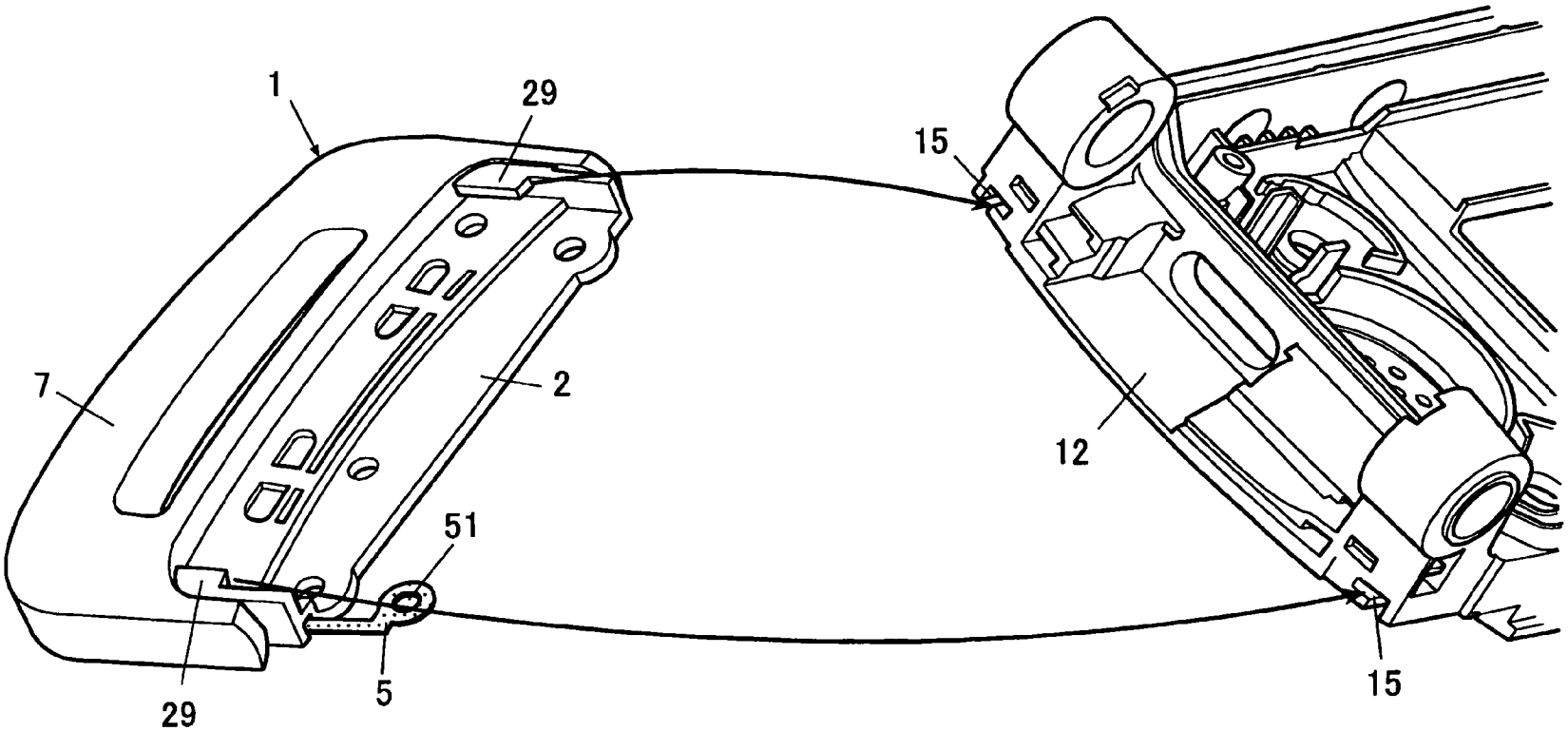
FIG. 6 is a perspective view showing the antenna detached from a bottom casing.
Figure 7B:
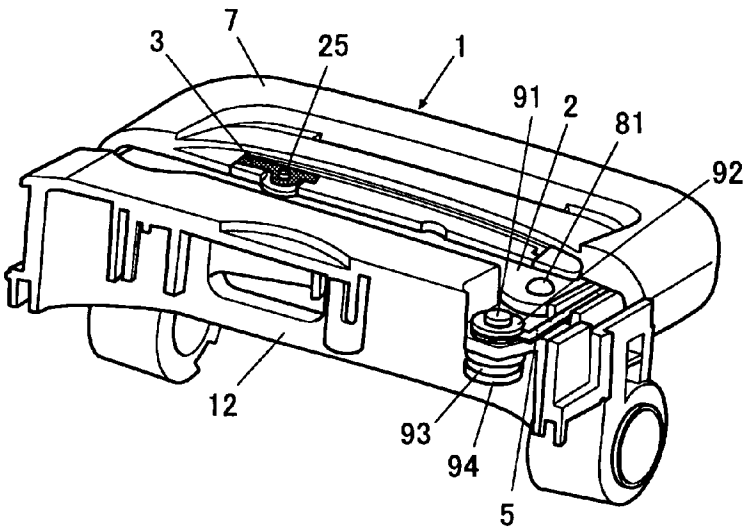
FIG. 7B is a perspective view showing the bottom casing and the antenna with the bottom casing partially cut.
Figure 7A:
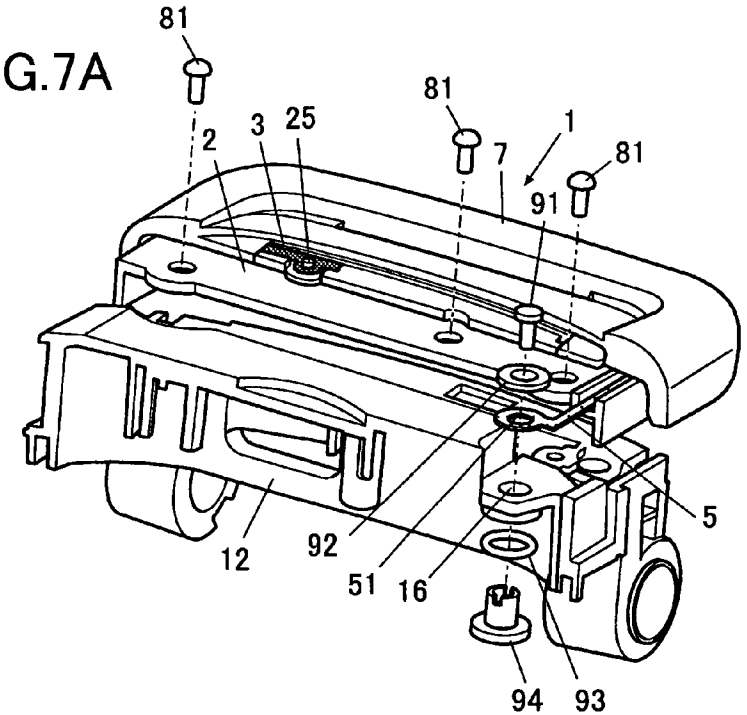
FIG. 7A is an exploded perspective view showing the bottom casing and the antenna with the bottom casing partially cut.

Next, an explanation will be given of a structure of attaching the antenna 1 structured as explained above to the bottom casing 12. As shown in FIG. 6, the support member 2 has right and left guides 29 formed at the front face thereof, and the bottom casing 12 has right and left guide grooves 15 formed at the end portion thereof at the hinge portion 13 side. The guides 29 are inserted into the respective guide grooves 15, and the tabular portion of the support member 2 is fixed to the bottom casing 12 by screws 81, thereby attaching the antenna 1 to the bottom casing 12 (see, FIGS. 7A and 7B). As shown in FIGS. 7A and 7B, the bottom casing 12 has a through hole 16 which allows the second antenna element 5 to be connected to the circuit in the bottom casing 12 and is formed in the end portion of the bottom casing 12 at the hinge portion 13 side. The through hole 51 of the second antenna element 5 is aligned with the through hole 16, a screw 91 is caused to pass through a washer 92, the through hole 51, the through hole 16, and an O-ring 93 in this order, and the screw 91 is threaded in an antenna terminal 94, thereby fixing the second antenna element 5 to the bottom casing 12. The antenna terminal 94 is then connected to the circuit in the bottom casing 12 through a non-illustrated contact point spring or the like. The O-ring 93 is provided for preventing water from entering the bottom casing 12 through the through hole 16.

Next, an explanation will be given of the characteristic of the antenna 1 structured as mentioned above.

Figure 8:
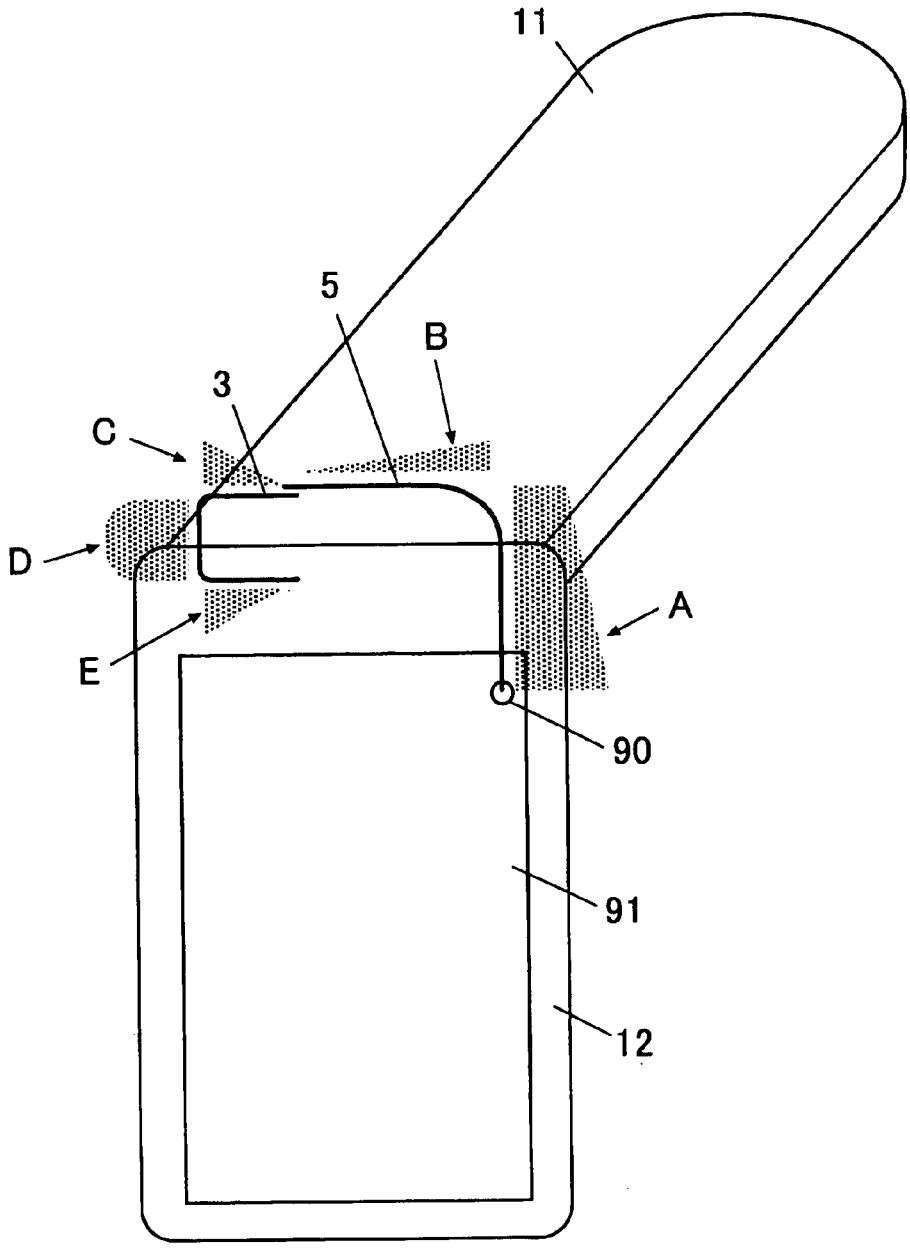
FIG. 8 is a diagram showing the distributions of largeness of high-frequency currents in an embodiment of the invention.
Figure 9:
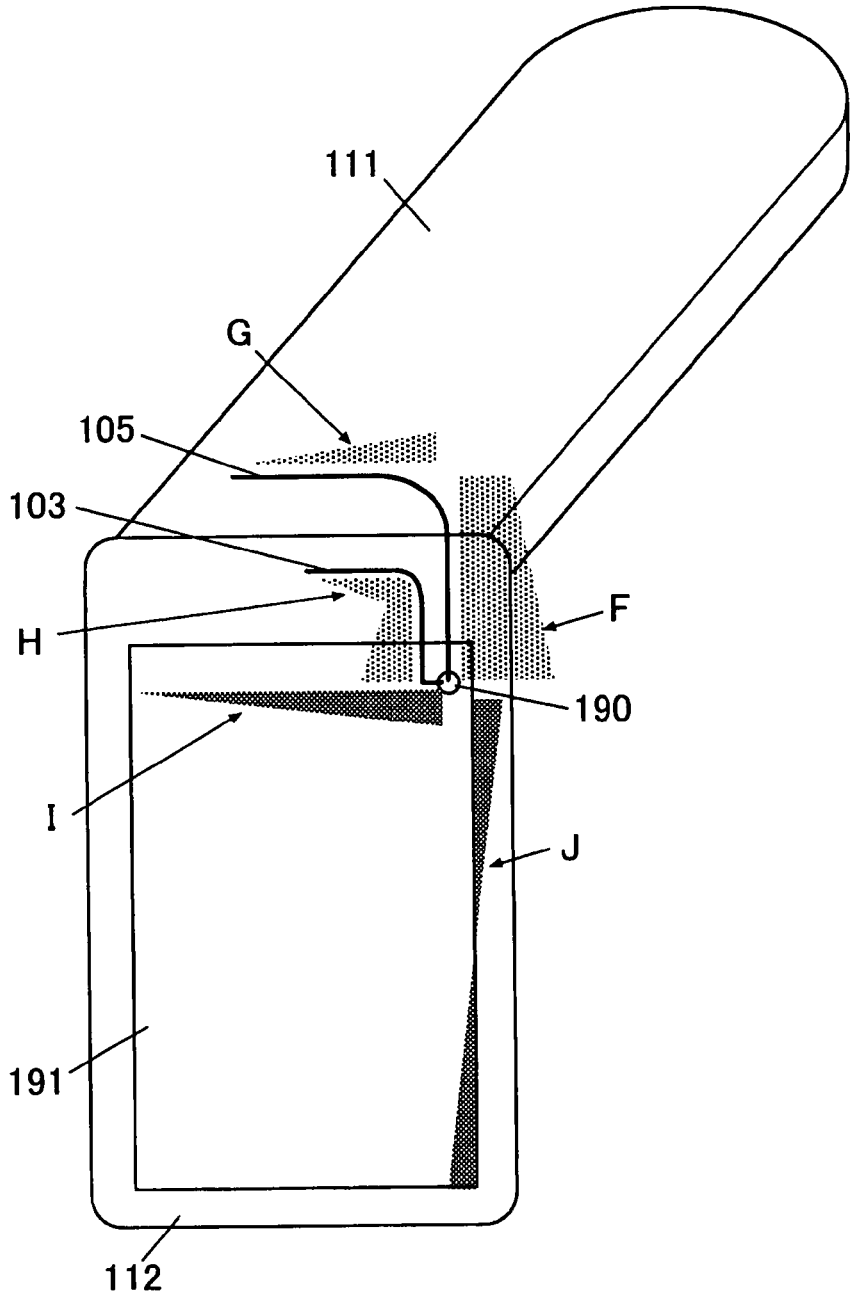
FIG. 9 is a diagram showing the distributions of largeness of high-frequency currents in a comparative example.

FIG. 8 exemplifies the distributions of largeness of high-frequency currents induced to the first antenna element 3 and the second antenna element 5 when power is supplied or when a radio wave is received, with the antenna 1 attached to the end portion of the bottom casing 12 at the hinge portion 13 side as shown in FIG. 1. FIG. 9 exemplifies the distributions of largeness of high-frequency currents induced to a first antenna element 103 and a second antenna element 105 when power is supplied or when a radio wave is received, in a case where the first antenna element 103 and the second antenna element 105 are arranged in parallel like the arrangement of the antenna elements (21A, 21B) disclosed in Unexamined Japanese Patent Application KOKAI Publication No. 2002-64329 as an comparative example.

Note that the electrical length of the first antenna element 3 in FIG. 8 is a half wavelength of a radio wave having the center frequency of the 2 GHz band, the electrical length of the second antenna element 5 is a quarter wavelength of a radio wave having the center frequency of the 800 MHz band, but because the antenna arrangement in the comparative example shown in FIG. 9 is one that the first antenna element 103 and the second antenna element 105 are arranged in parallel, the electrical length of the first antenna element 103 in FIG. 9 is a quarter wavelength of a radio wave having the center frequency of the 2 GHz band, and the electrical length of the second antenna element 105 is a quarter wavelength of a radio wave having the center frequency of the 800 MHz band.

Note that symbols A and B in FIG. 8 represent the distributions of largeness of high-frequency currents induced to the second antenna element 5 when power of 800 MHz is supplied from a power feeding terminal 90 connected to a main substrate (circuit board) 91, and symbols C to E represent the distributions of largeness of high-frequency currents induced to the first antenna element 3 when power of 2 GHz is supplied from the power feeding terminal 90.

Symbols F and G in FIG. 9 represent the distributions of largeness of high-frequency currents induced to the second antenna element 105 when power of 800 MHz is supplied from a power feeding terminal 190 provided at a main substrate (circuit board) 191, and a symbol H represents the distributions of largeness of high-frequency currents induced to the first antenna element 103 when power of 2 GHz is supplied from the power feeding terminal 190. Further, symbols I and J represent the distributions of largeness of high-frequency currents induced to the main substrate 191 when power of 2 GHz is supplied from the power feeding terminal 190.

As known from the comparison between FIG. 8 and FIG. 9, FIG. 8 does not show the distribution of high-frequency currents corresponding to the symbols I and J of FIG. 9. This is because almost no high-frequency current is induced to the main substrate 91 when 2 G Hz power is supplied to the first antenna element 3, as the electrical length of the first antenna element in FIG. 8 is a half wavelength of a radio wave having the center frequency of the 2 GHz band.

Because the electrical lengths of the second antenna element 5 in FIG. 8 and the second antenna element 105 in FIG. 9 are a quarter wavelength of a radio wave having the center frequency of the 800 MHz band, high-frequency currents are induced to the main substrates 91, 191 when 800 MHz power is supplied to the second antenna elements 5, 105, but the illustration of the distribution of the largeness of these high-frequency currents is omitted in FIG. 8 and FIG. 9.

Figure 10:
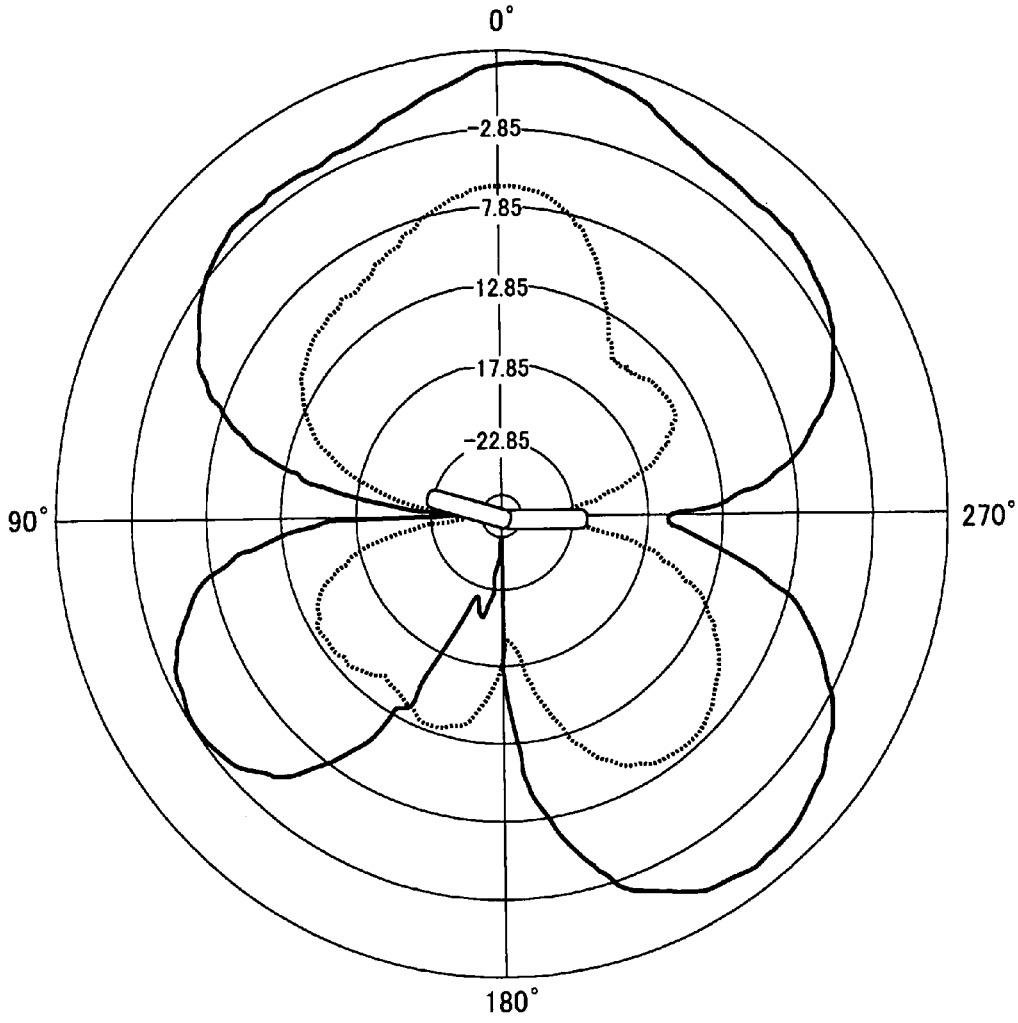
FIG. 10 is a diagram showing the directivities of basic polarized wave components.
Figure 11:
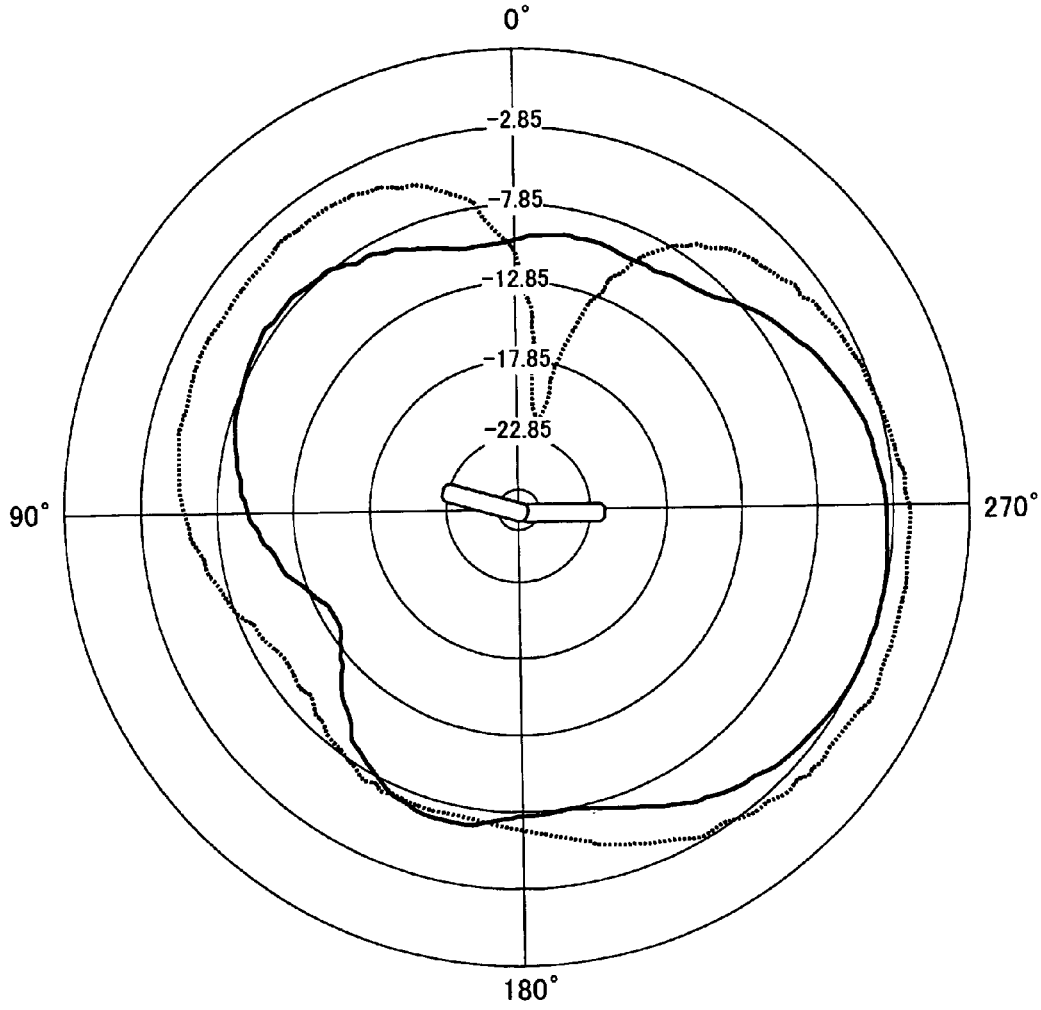
FIG. 11 is a diagram showing the directivities of cross-polarized wave components.

FIGS. 10 and 11 show the directivities of radio waves. A directivity as viewed from the side face when the cellular phone in FIG. 1 in the embodiment is opened is represented by a solid line, while a directivity as viewed from the side face when a cellular phone of the comparative example shown in FIG. 9 is opened is represented by a dashed line in FIGS. 10 and 11.

In FIG. 10, a radial direction indicates the intensity (dBd) of a basic polarized wave component (vertical polarized wave component) of 2 GHz, and in FIG. 11, a radial direction indicates the intensity (dBd) of a cross-polarized wave component (horizontal polarized wave component) of 2 GHz. As is apparent from FIG. 10, the intensity of a basic polarized wave component in the embodiment is larger than that of the comparative example in most directions.

As explained above, according to the embodiment, a capacitor is constituted between the end portion of the first antenna element 3 and the end portion of the second antenna element 5, and the first antenna element 3, the capacitor, and the second antenna element 5 are connected in series, so that as the other end of the second antenna element 5 is caused to serve as a power feeding end and is connected to a circuit in the bottom casing 12, the first antenna element 3 can transmit/receive a radio wave in the 2 GHz band, and the second antenna element 5 can transmit/receive a radio wave in the 800 MHz band.

Therefore, it is not necessary to provide individual power feeding ends for the first antenna element 3 and the second antenna element 5, and the other end portion of the second antenna element 5 can be used as a common power feeding end, thereby enabling resonance for different frequency bands with a simple structure.

The first antenna element 3 and the second antenna element 5 are both formed in a band-like shape and connected in series via the band-like and sheet-like dielectric element 4, so that a space which is wide in two dimensions to dispose those elements becomes unnecessary. Further, it is possible to set the planar shape of the first antenna element 3 and the second antenna element 5 relatively freely by providing a curved portion and a bent portion to the first antenna element 3 and the second antenna element 5.

That is, there is little limitation on the place or space where the first antenna element 3 and the second antenna element 5 are disposed, and the first antenna element 3, the dielectric element 4 and the second antenna element 5 can be disposed at a narrow space.

Further, since the first antenna element 3 and the second antenna element 5 have a band-like shape and the dielectric element 4 between the end portion of the first antenna element 3 and the end portion of the second antenna element 5 has a sheet-like shape, a clearance between the end portion of the first antenna element 3 and the end portion of the second antenna element 5 can be kept in the thickness of the dielectric element 4. Therefore, the capacitance of the capacitor can be set with high accuracy, and the electrical characteristic of the antenna 1 can be stabilized. Further, because of the dielectric constant of the dielectric element 4, that portion where the end portion of the first antenna element 3 and the end portion of the second antenna element 5 overlap with each other can be miniaturized.

Because the electrical length of the first antenna element 3 is a half wavelength of a radio wave having the center frequency of a frequency band transmitted/received by the first antenna element 3, high-frequency currents induced when a radio wave of this frequency band is transmitted/received have dominant distributions on the first antenna element 3. As a result, currents which flow through conductive portions other than the antenna 1 are greatly reduced inside or outside the casings 11, 12, and the antenna characteristic becomes good. This effect is particularly remarkable in a case where the frequency band to be transmitted/received is the 2 GHz band.

That is, in a case where the frequency band to be transmitted/received is the 2 GHz band, the quarter wavelength of this band is 3.75 cm or so (3.5 to 4.4 cm) and is almost the same as the width of the casings 11, 12, so that an antenna element having an electrical length corresponding to a quarter wavelength of a 2 GHz band has a problem that currents in the width direction of the casings 11, 12 increase, and vertical polarized wave components necessary from the standpoint of the radiation characteristic of a system are reduced. In the embodiment, however, because the first antenna element 3 has the electrical length corresponding to a half wavelength of a radio wave in a frequency band transmitted/received by the first antenna element 3, unnecessary currents in the width direction can be extremely reduced even though the frequency band transmitted/received is the 2 GHz band, and the vertical polarized wave components necessary from the standpoint of the radiation characteristic can be increased proportionately. Moreover, in the present embodiment, because the first antenna element 3 is formed in a letter U shape, deterioration of a vertical polarized wave component of 2 GHz can be suppressed, and the reception condition of the vertical polarized wave component can be maintained well.

Further, currents which flow through conductive portions other than the antenna 1 are extremely low inside or outside the casings 11, 12, so that currents in the lengthwise direction inside or outside the casings 11, 12 are reduced. Therefore, a high-performance antenna 1 which is less affected by a person's hand which holds the cellular phone can be realized.

Because a frequency band (2 GHz band) that the first antenna element 3 copes with is higher than a frequency band (800 MHz band) that the second antenna element 5 copes with, the total length of the length of the first antenna element 3 with the length of the second antenna element 5 can be reduced more than in a case where the frequency bands are reversely coped with by the other of the antenna elements, thereby miniaturizing the antenna 1.

Because the exterior resin 7 is made of a rubber-based resin, the antenna 1 has a good impact strength. Therefore, even if the antenna 1 is attached to the bottom casing 12 in a protruding manner therefrom, breakage of the antenna 1 originating from falling of the cellular phone 10 can be prevented.

Further, because the antenna 1 is attached outside the casings 11, 12, not inside the casings 11, 12, it is not necessary to provide a space for housing the antenna inside the casings 11, 12. Therefore, miniaturization of the casings 11, 12 is realized while satisfying the requirements for design and mechanical characteristics of the casings 11, 12.

The present invention is not limited to the foregoing embodiment, but can be modified and changed in various forms within the scope of the invention.

For example, in the foregoing embodiment, the dielectric element sandwiched between the end portion of the first antenna element 3 made of a metallic plate and the end portion of the second antenna element 5 made of a metallic plate is a sheet-like dielectric element. However, the dielectric element may be a plate-like dielectric element. That is, the dielectric element may be any board-like dielectric element that has an appropriate wall thickness.

Further, in the foregoing embodiment, the explanation has been given of the antenna outwardly attached to the casing of the cellular phone 10 as an example, but the antenna of the invention employs a structure such that the first antenna element 3 and the second antenna element 5 are connected in series through the dielectric element, does not therefore require a space which is wide in two dimension as a mounting space, and can relatively freely set the planar shape of the first antenna element 3 and the second antenna element 5, so that the antenna of the invention can be mounted along the edge of the circuit board or the inside wall of the casing. In this case, it is necessary to make sure that the dielectric element 4 is sandwiched between the end portion of the first antenna element 3 and the end portion of the second antenna element 5. As methods therefor, there are a method of molding the portion where the three members overlap or the antenna as a whole with resin such as rubber-based resin, etc., and a method of joining the end portion of the first antenna element 3 and the dielectric element 4, and the end portion of the second antenna element 5 and the dielectric element 4 with an adhesive such as a rubber adhesive, etc. Any of these methods may be used.

Further, the antenna may be formed of FPC (Flexible Printed Circuits) which include two layers as conductive layers. In this case, for example, the pattern of a first antenna element may be formed on one conductive layer, while the pattern of a second antenna element may be formed on the other conductive layer such that one end of the pattern overlaps with one end of the pattern of the first antenna element, and thereafter the FPC may be punched out along the edge of both of the patterns. Thereby, a base film on the portion where the pattern of the first antenna element and the pattern of the second antennal element overlap with each other serves as a capacitor like the dielectric element 4 in the foregoing embodiment.

In the foregoing embodiment, the explanation has been given of the cellular phone 10 as an example of the portable wireless device, but the invention can be applied to the antenna of an electronic device having a function of transmission/reception of a radio wave, such as a laptop computer, a wrist watch, a PDA (Personal Digital Assistance), an electronic organizer, or other electronic devices.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2006-178830 filed on Jun. 28, 2006, and the contents of which are incorporated in this specification as references.

What is claimed is:

1. An antenna comprising:

a first U-shaped antenna element formed in a band-like shape for a first frequency band;

a second antenna element not physically connected to said first antenna element and formed in a band-like shape for a second frequency band, and having one end portion partially overlapped with one end portion of the U-shaped first antenna element, the one end portion of the second antenna element extending in a direction opposite to a direction of extension of the one end portion of the U-shaped first antenna element; and a dielectric element sandwiched between the first antenna element and the second antenna element at that portion where the first antenna element and the second antenna element overlap with each other, wherein an other end of the second antenna element serves as a power feeding end, wherein the first antenna element and the second antenna element overlap at an end of a leg of the U-shaped first antenna element in an area of the dielectric.

2. The antenna according to claim 1, wherein the first antenna element has an electrical length which is a half wavelength of a center frequency of the first frequency band, and the second antenna element has an electrical length which is a quarter wavelength of a center frequency of the second frequency band.

3. The antenna according to claim 2, wherein a frequency in the first frequency band is higher than a frequency in the second frequency band.

4. The antenna according to claim 1, wherein the first antenna element and the second antenna element are made of a metal which is anticorrosive.

5. The antenna according to any one of claim 1, wherein the first antenna element, and dielectric element, and the second antenna element are wrapped by a rubber-based resin.

6. The antenna according to claim 5, wherein the first antenna element, the dielectric element, and the second antenna element are laid out on a surface of a support member, and wrapped together with the support member by the rubber-based resin.

7. The antenna according to claim 6, wherein the support member includes a band-like groove on its surface, and the first antenna element, the dielectric element, and the second antenna element are retained in the band-like groove.

8. The antenna according to any one of claim 1, wherein the dielectric element is board-like.

9. A portable wireless device having the antenna according to claim 1.

10. A portable wireless device having the antenna according to claim 2.

11. A portable wireless device having the antenna according to claim 3.

12. A portable wireless device having the antenna according to claim 4.

13. A portable wireless device having the antenna according to claim 4.

14. A portable wireless device having the antenna according to claim 5.

15. A portable wireless device having the antenna according to claim 6.

16. A portable wireless device having the antenna according to claim 7.

17. A portable wireless device having the antenna according to claim 8.

* * * * *